US009654864B2

(12) United States Patent
Tracy

(10) Patent No.: US 9,654,864 B2
(45) Date of Patent: May 16, 2017

(54) LOUDSPEAKER MODULE

(71) Applicant: Dennis A Tracy, Culver City, CA (US)

(72) Inventor: Dennis A Tracy, Culver City, CA (US)

( * ) Notice: Subject to any disclaimer, the term of this patent is extended or adjusted under 35 U.S.C. 154(b) by 6 days.

(21) Appl. No.: 14/933,571

(22) Filed: Nov. 5, 2015

(65) Prior Publication Data

US 2016/0134964 A1 May 12, 2016

Related U.S. Application Data

(60) Provisional application No. 62/076,155, filed on Nov. 6, 2014.

(51) Int. Cl.
*H04R 1/20* (2006.01)
*H04R 1/28* (2006.01)
*H04R 1/26* (2006.01)

(52) U.S. Cl.
CPC ..... *H04R 1/2811* (2013.01); *H04R 1/26* (2013.01)

(58) Field of Classification Search
CPC ..... H04R 1/02; H04R 1/2842; H04R 1/025; H04R 1/2811; H04R 1/2834; H04R 1/288; H04R 2201/021; H04R 2499/13; H04R 9/022; H04R 1/2896; H04R 3/00; H04R 5/02; H04R 2205/021; H04R 2201/028; H04R 1/24; H04R 1/2884; H04R 1/2807
USPC ..... 381/351, 182, 184, 186; 181/224
See application file for complete search history.

(56) References Cited

U.S. PATENT DOCUMENTS

| | | | | |
|---|---|---|---|---|
| 4,182,429 | A | 1/1980 | Senzaki | |
| 4,811,406 | A | 3/1989 | Kawachi | |
| 4,953,223 | A * | 8/1990 | Householder | F16M 11/24 381/182 |
| 5,146,508 | A | 9/1992 | Bader | |
| 5,388,162 | A | 2/1995 | Sohn | |
| 5,512,714 | A | 4/1996 | Fenton | |
| 6,282,297 | B1 | 8/2001 | Lin | |
| 6,460,651 | B1 | 10/2002 | Sahyoun | |
| 6,493,455 | B1 | 12/2002 | Tracy | |
| 8,577,073 | B2 | 11/2013 | Tracy | |
| 2007/0160246 | A1 * | 7/2007 | Vollmer | H04R 1/42 381/336 |

* cited by examiner

*Primary Examiner* — Curtis Kuntz
*Assistant Examiner* — Julie X Dang
(74) *Attorney, Agent, or Firm* — Welsh Flaxman & Gitler LLC

(57) ABSTRACT

A loudspeaker module includes a housing composed of a hollow spherical central section having a central cavity and a plurality of wing members extending from the spherical central section. Each of the plurality of wing members includes a wing member cavity in fluid communication with the central cavity of the spherical central section. A central driver mounting plate secures a low-frequency driver to an aperture formed in the spherical central section. A loudspeaker module may also include a mid-range/high-frequency driver where a full range of sound frequencies are desired.

12 Claims, 6 Drawing Sheets

LOUDSPEAKER MODULE

CROSS REFERENCE TO RELATED APPLICATION

This application claims the benefit of U.S. Provisional Patent Application Ser. No. 62/076,155, entitled "SUBWOOFER MODULE," filed Nov. 6, 2014.

BACKGROUND OF THE INVENTION

1. Field of the Invention

The present invention relates to loudspeakers. More particularly, the invention relates to a low-frequency loudspeaker module, that is, a subwoofer module. Still further, the present invention relates to a loudspeaker integrating both a subwoofer and mid-range/high-frequency driver within a single housing to produce a loudspeaker module capable of reproducing a full range of sounds.

2. Description of the Related Art

Loudspeaker technology has consistently attempted to reproduce a recorded sound in the most realistic manner possible. In fact, the goal of many designers is the creation of a loudspeaker which sounds as if the singer and/or musician are playing across the room.

The vast majority of loudspeaker designs employ a variety of sound drivers mounted within an acoustic box. The sound drivers are mounted along a face of the acoustic box in the direction along which the sound is to be directed. These designs dictate that relatively large drivers are mounted within a relatively large box.

While these large loudspeakers often produce very high quality sound, their size makes them difficult, if not impossible, to discreetly position within a room. Many manufacturers have attempted to remedy size problems by providing small loudspeakers sized to conveniently sit on a bookshelf or coffee table. Unfortunately, the small loudspeakers sacrifice sound quality for size. Since they are smaller and may not accommodate drivers for a variety of frequency ranges, they are unable to offer the full range of sound larger loudspeakers offer.

The overwhelming popularity and usefulness of personal computers have made lack of small, high quality loudspeakers even more apparent. Computer users require high quality sound to play games, listen to music and even watch movies on their monitors. In some instances, an individual's computer forms the central module in an elaborate multimedia environment including DVD, Dolby Digital processing and high-definition television. When all of these quality components interact to create a realistic entertainment environment, it is highly frustrating to settle for moderate quality loudspeakers because high quality loudspeakers are simply too big to place on a desktop. As such, a need exists for small, aesthetically pleasing loudspeakers, which do not sacrifice sound quality for reductions in the size of the loudspeakers. The present loudspeaker system overcomes the limitations of the prior art.

SUMMARY OF THE INVENTION

It is, therefore, an object of the present invention to provide a subwoofer module including a housing composed of a hollow spherical central section having a central cavity and a plurality of wing members extending from the spherical central section. Each of the plurality of wing members includes a wing member cavity in fluid communication with the central cavity of the spherical central section. A central driver mounting plate secures a low-frequency driver to an aperture formed in the spherical central section.

It is also an object of the present invention to provide a subwoofer module wherein the housing is substantially spherical.

It is a further an object of the present invention to provide a subwoofer module wherein the plurality of wing members includes pairs of wing members oriented parallel to each other.

It is also an object of the present invention to provide a subwoofer module wherein each of the plurality of wing members includes an upper surface, a bottom surface and a side wall extending between the upper surface and the bottom surface, the upper surface, the bottom surface and the side wall define a wing member cavity which is in fluid communication with the central cavity of the spherical central section.

It is another object of the present invention to provide a subwoofer module wherein the plurality of wing members includes three pairs of wing members oriented parallel to each other.

It is also an object of the present invention to provide a subwoofer module wherein the low-frequency driver is positioned to fire away from the central cavity of the spherical central section with a convex portion of a cone of the low-frequency driver facing the central cavity of the spherical central section.

It is a further object of the present invention to provide a subwoofer module including an excursion spacer secured to and in alignment with the low-frequency driver.

It is also an object of the present invention to provide a subwoofer module including an upper baffle plate and a lower baffle plate secured to and in alignment with the low-frequency driver.

It is another object of the present invention to provide a subwoofer module wherein the upper baffle plate is a disk-like member having a foam core that functions as a filter for unwanted frequencies transmitted by the low-frequency driver.

It is a further object of the present invention to provide a subwoofer module wherein the lower baffle plate is frustoconically shaped and includes inner and outer walls between which is positioned a foam gasket. The inner and outer walls include a series of apertures shaped and dimensioned to optimize sound transmitted by the subwoofer module.

It is also an object of the present invention to provide a loudspeaker module including a housing composed of a primary housing portion and a pivotally secured housing portioning defining a mid-range/high-frequency driver support having a mid-range/high-frequency driver secured thereto. The primary housing portion includes a hollow spherical central section having a central cavity. A central driver mounting plate secures a low-frequency driver to an aperture formed in the spherical central section.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
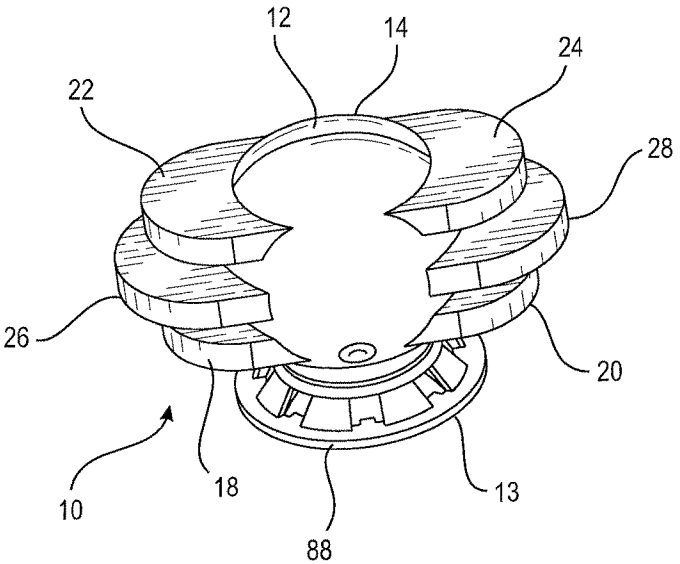
FIG. 1 is top perspective view of a subwoofer module in accordance with the present invention.
Figure 2:
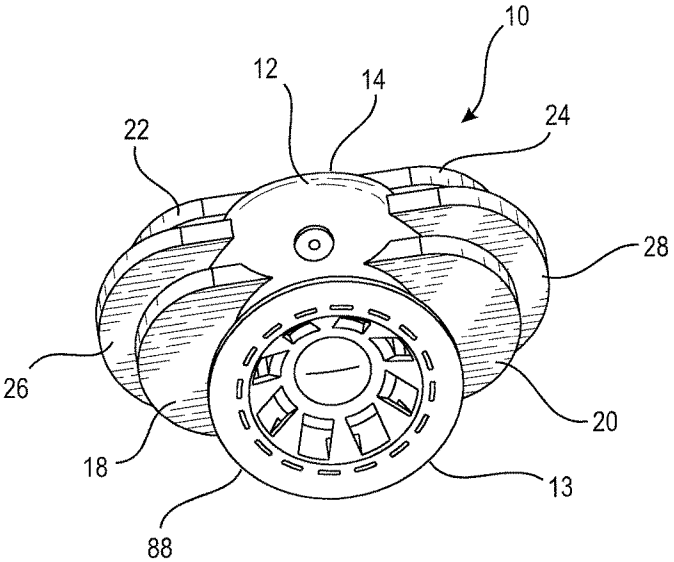
FIG. 2 is a bottom perspective view of the subwoofer module shown in FIG. 1.
Figure 3:
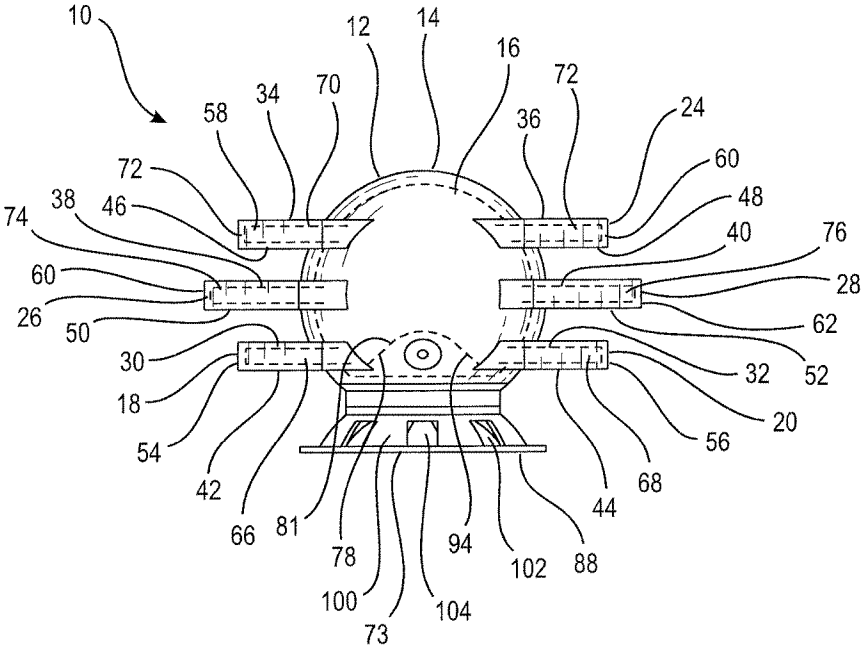
FIG. 3 is a front plan view of the subwoofer module shown in FIG. 1.
Figure 4:
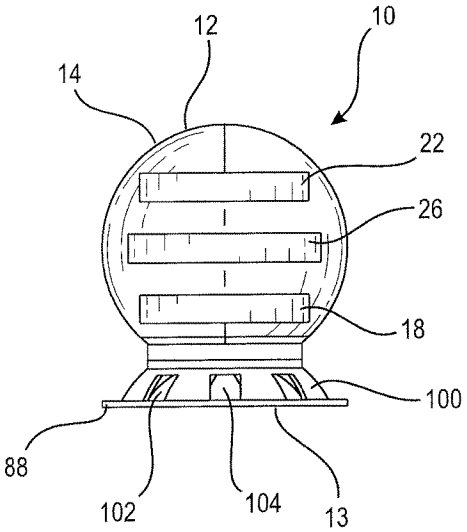
FIG. 4 is a side plan view of the subwoofer module shown in FIG. 1.
Figure 5:
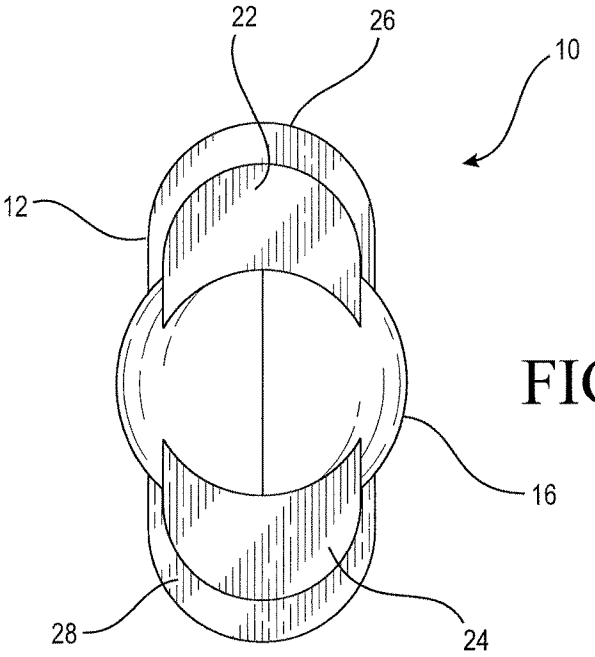
FIG. 5 is a top plan view of the subwoofer module shown in FIG. 1.
Figure 6:
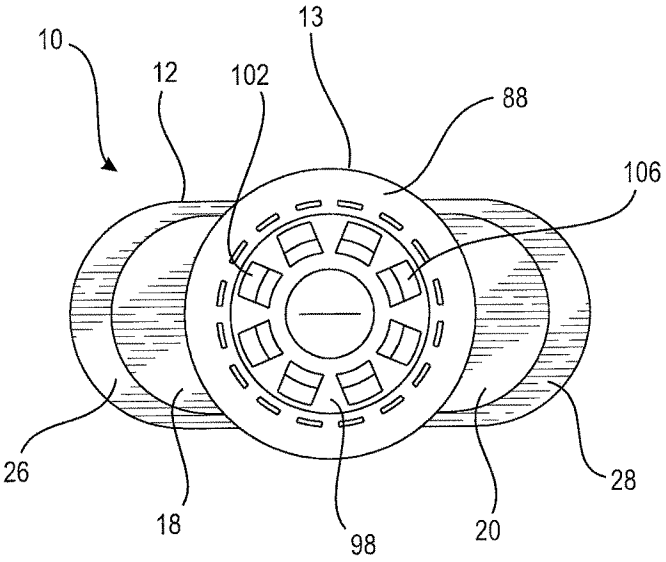
FIG. 6 is a bottom plan view of the subwoofer module shown in FIG. 1.
Figure 7:
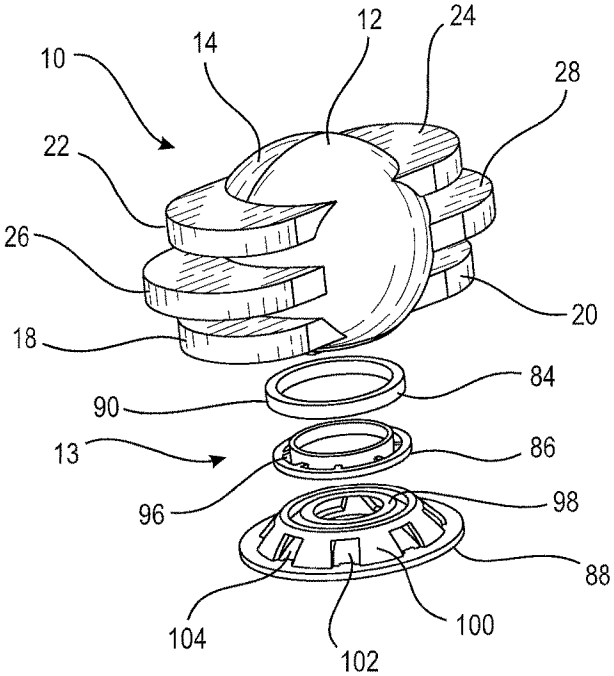
FIGS. 7 and 8 are respectively exploded view showing the subwoofer module from different angles.
Figure 8:
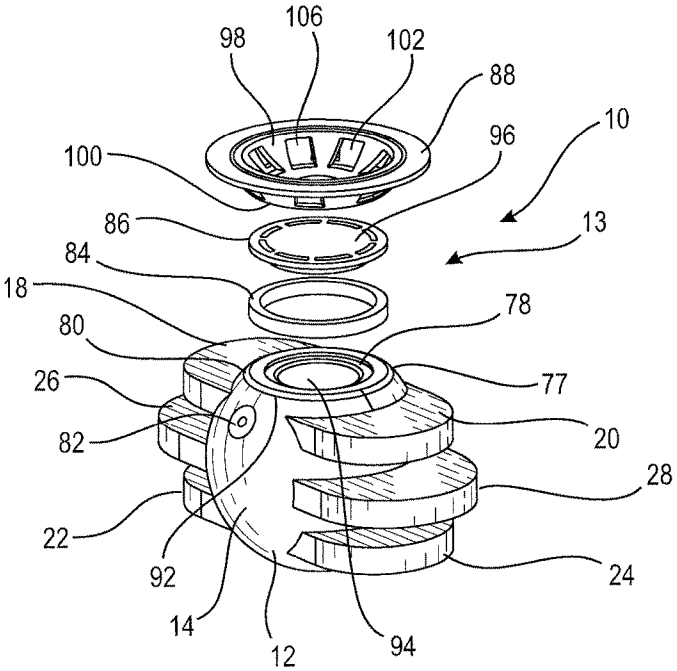

With reference to FIGS. 1 to 8, a subwoofer module 10 is disclosed. The subwoofer module 10 is particularly designed for desktop use in conjunction with computers, although it is appreciated the subwoofer module 10 may be used in various other environments without departing from the spirit of the present invention. The present subwoofer module 10 is particularly designed for horizontal positioning upon a flat floor or a flat supporting surface.

The subwoofer module 10 includes a substantially spherical housing 12 with a base structure 13 extending therefrom. The housing 12 is preferably manufactured from various resins. More particularly, the housing 12 is preferably manufactured from plastic, for example, ABS. While preferred materials are disclosed in accordance with the preferred embodiment of the present invention, it is contemplated other materials may be used without departing from the spirit of the present invention. Regardless of the material used and the construction of the housing 12, the chosen material should resonate in a manner transmitting sound from the interior of the housing 12.

The housing 12 is composed of a hollow spherical central section 14 having a central cavity 16. The housing 12 also includes a plurality of wing members 18, 20, 22, 24, 26, 28 extending from the spherical central section 14. In particular, three sets of opposed wing members are positioned along the housing 12 at various diametric locations. The pairs of wing members are oriented parallel to each other. Each of the wing members 18, 20, 22, 24, 26, 28 includes an upper surface 30, 32, 34, 36, 38, 40, a bottom surface 42, 44, 46, 48, 50, 52 and a side wall 54, 56, 58, 60, 62, 64 extending between the upper surface 30, 32, 34, 36, 38, 40 and the bottom surface 42, 44, 46, 48, 50, 52. The upper surface 30, 32, 34, 36, 38, 40, the bottom surface 42, 44, 46, 48, 50, 52 and the side walls 54, 56, 58, 60, 62, 64 define a wing member cavity 66, 68, 70, 72, 74, 76 which is in fluid communication with the cavity 16 of the spherical central section 14.

With this in mind, first and second lower wing members 18, 20 are positioned at a position beneath the equatorial circumference of the spherical central section 14. The first lower wing member 18 includes an upper surface 30, a bottom surface 42 and a side wall 54 defining a wing member cavity 66. The second lower wing member 20 includes an upper surface 32, a bottom surface 44 and a side wall 56 defining a wing member cavity 68 within the space defined by the upper surface 32, the bottom surface 44 and the side wall 56.

Above the equatorial circumference of the spherical housing 12 are first and second upper wing members 22, 24. The first upper wing member 22 includes an upper surface 34, a bottom surface 46 and a side wall 58 extending between the upper and lower surfaces 34 so as to define a wing member cavity 70, while the second upper wing member 24 includes an upper surface 36, a bottom surface 48 and a side wall 60 extending therebetween so as to define a wing member cavity 72 therein.

Between the first and second upper wing members 22, 24 and the first and second lower wing members 18, 20 first and second central wing members 26, 28 are positioned along the equatorial plane of the spherical housing 12. The first central wing member 26 includes an upper surface 38, a lower surface 50 and a side wall 62 extending therebetween so as to define a wing member cavity 74, while the second central wing member 28 defines an upper surface 40, a lower surface 52 and a side wall 64 extending therebetween so as to define a wing member cavity 76.

A central driver mounting plate 77 is secured to the spherical central section 14 at a position beneath the first and second lower wing members 18, 20 in a central location along the spherical central section 14. A low-frequency driver 78 (for example producing sound in the range of approximately 40 Hz to approximately 1,000 Hz) is mounted to the driver mounting plate 77 in alignment with an aperture 80 formed in the driver mounting plate 77. The low-frequency driver 78 is positioned to fire away from the central cavity 16 of the spherical central section 14 with the convex portion 81 of the cone 94 of low-frequency driver 78 facing the cavity 16 of the spherical central section 14.

Positioned beneath the low-frequency driver 78, and functioning as both a support and filter for the subwoofer module 10, is the base assembly 13. The base assembly 13 includes an excursion spacer 84, an upper baffle plate 86 and a lower baffle plate 88. Each of the excursion spacer 84, the upper baffle plate 86 and the lower baffle plate 88 are symmetrically constructed and include a central axis aligned with the low-frequency driver 78 so as to allow for the transmission of sound from the low-frequency driver 78 and through the base assembly 13.

The excursion spacer 84 is a cylindrical member 90 that is secured to the outer support structure 92 of the low-frequency driver 78 and provides ample space for the movement of the cone 94 of the low-frequency driver 78. The excursion spacer 84 is positioned between the upper baffle plate 86 and the low-frequency driver 78. The upper baffle plate 86 is a disk-like member having a foam core 96 that functions as a filter for unwanted frequencies transmitted by the low-frequency driver 78. The lower baffle plate 88 is secured beneath, and in alignment with, the upper baffle plate 86. The lower baffle plate 88 also functions as an acoustic filter.

The lower baffle plate 88 is frusto-conically shaped. The lower baffle plate 88 includes an inner wall 98 and an outer wall 100 between which is positioned a foam gasket 102. The inner wall 98 includes a series of apertures 106 and the outer wall 100 includes a series of apertures 104. The apertures 104, 106 of the inner wall 98 and outer wall 100 are shaped and dimensioned to optimize the sound transmitted by the present subwoofer module 10. While specific shapes are disclosed above for the elements of the base assembly 13 and the low-frequency driver 78, it is appreciated the shapes may be varied to optimize sound characteristics generated in accordance with the present subwoofer module 10.

The housing 12 is further provided with a wire passage aperture 82 for the passage therethrough of wires (not shown) powering the low-frequency driver 78. In accordance with the preferred embodiment, the wire passage aperture 82 is formed in a wall of the spherical central section 14 at a position adjacent to the driver mounting plate 76. The resulting subwoofer module 10 is wired in a conventional manner, which those skilled in the art will readily appreciate. As such, variations in wiring are contemplated in accordance with the spirit of the present invention, for example, the subwoofer module may be constructed for traditional wired use or be constructed for use in a wireless (for example, Bluetooth) enabled manner.

The sealed enclosure defined by the hollow spherical central section 14, the first and second upper wing members 22, 24, the first and second lower wing members 18, 20 and the first and second central wing members 26, 28, all of which make up the housing 12, results in the transmission of sound from the housing so as to resonate in conjunction with the low-frequency driver 78. The large surface area of the housing, achieved via the coupling of the spherical central section 14 and the wing members 18, 20, 22, 24, 26, 28, enhances the resonating characteristics of the housing 12. Additionally, the expanded cavity volume defined by the spherical central section 14 and the wing members 18, 20, 22, 24, 26, 28 increases the space behind the low-frequency driver 78 to optimize the efficiency and range of frequencies that may be reproduced. As a result, improved sound is achieved while retaining the relatively compact size of the subwoofer module.

Figure 10:
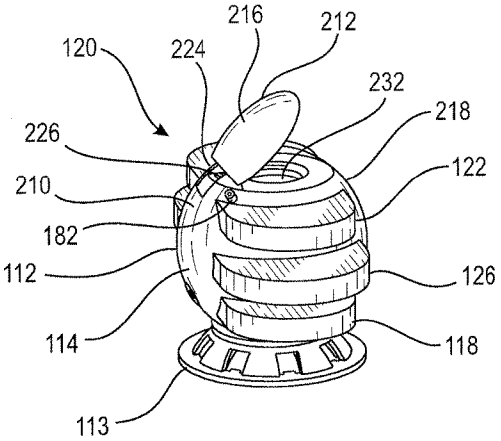
FIG. 10 is a side perspective view of the loudspeaker module, with a mid-range/high-frequency driver support in a partially open orientation, in accordance with the alternate embodiment shown with reference to FIG. 9.
Figure 9:
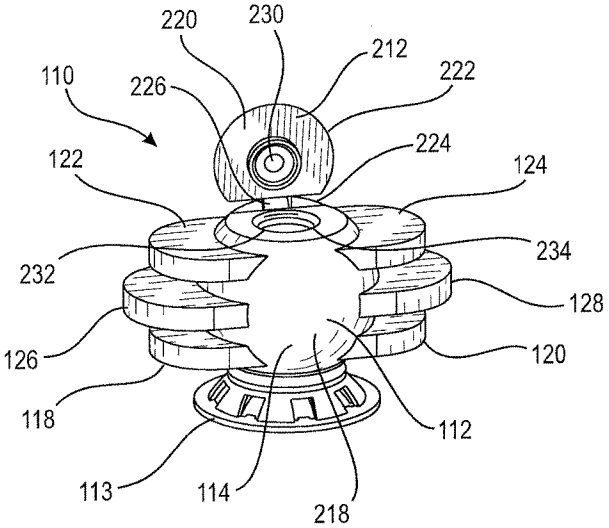
FIG. 9 is a front perspective view of a loudspeaker module, with a mid-range/high-frequency driver support in a fully open orientation, in accordance with an alternate embodiment of the present invention.
Figure 11:
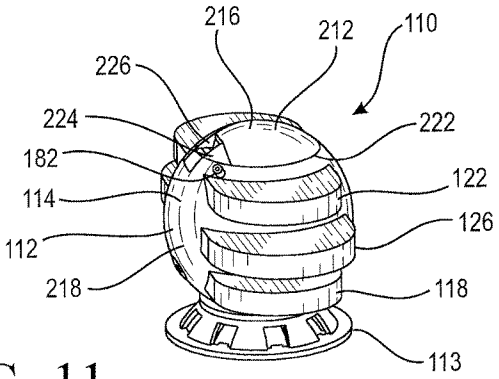
FIG. 11 is a side perspective view of the loudspeaker module, with a mid-range/high-frequency driver support in a closed orientation, in accordance with the alternate embodiment shown with reference to FIG. 9.
Figure 13:
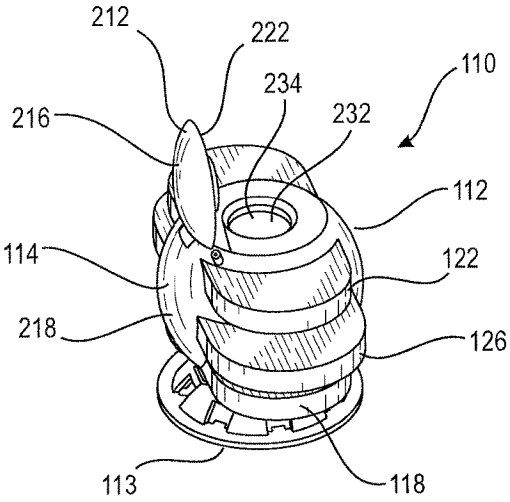
FIGS. 12 and 13 are respectively a front upper perspective view and a side upper perspective view of the loudspeaker module in accordance with the alternate embodiment shown with reference to FIG. 9.
Figure 14:
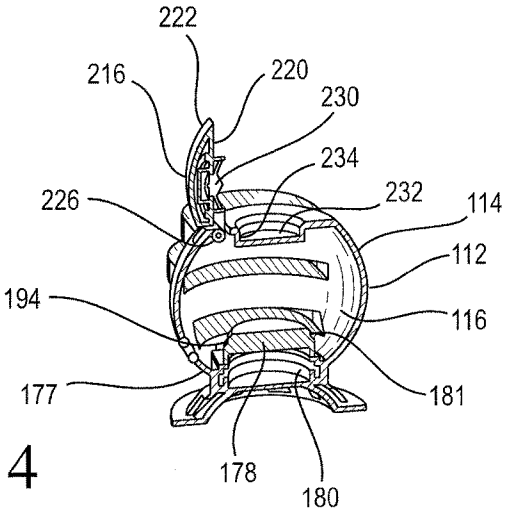
FIG. 14 is a cross sectional view of the loudspeaker module in accordance with the alternate embodiment shown with reference to FIG. 9.
Figure 12:
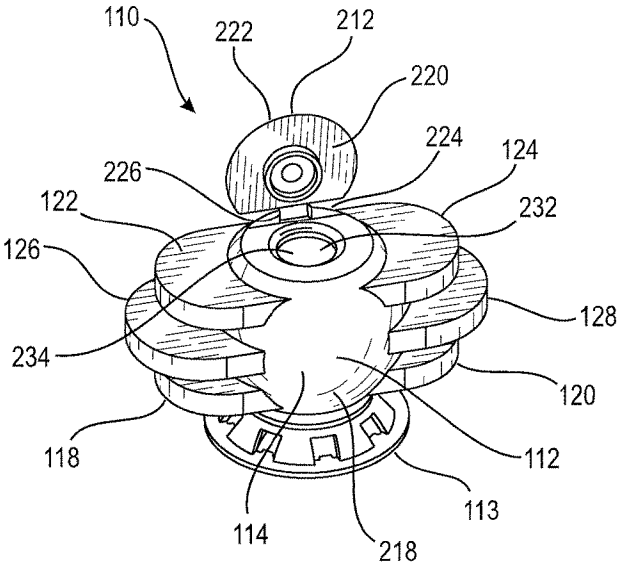

In accordance with an alternate embodiment, ae low-frequency driver 178 (identical to that of the embodiment disclosed above) may be combined with a mid-range/high-frequency driver 230 (producing sound within the range of 300 Hz to 20,000 Hz) within a single housing 112 to produce a loudspeaker module 110 as shown with reference to FIGS. 9 to 14. The loudspeaker module 110 includes a substantially spherical housing 112 with a base structure 113 extending therefrom. As will be appreciated based upon the following disclosure, the housing 112 is composed of two pivotally connected parts. In particular, the housing 112 includes a primary housing portion 210 and a pivotally secured housing portion defining a mid-range/high-frequency driver support 212.

As with the prior embodiment, the housing 112 is preferably manufactured from various resins. Regardless of the material used and the construction of the housing 112, the chosen material should resonate in a manner transmitting sound from the interior of the housing 112.

The housing 112, in particular, the primary housing portion 210, is composed of a hollow spherical central section 114 having a central cavity 116. The primary housing portion 210 also includes a plurality of wing members 118, 120, 122, 124, 126, 128 extending from the spherical central section 114. In particular, three sets of opposed wing members are positioned along the primary housing portion 210 at various diametric locations. The pairs of wing members are oriented parallel to each other. The wing members 118, 120, 122, 124, 126, 128 are constructed the same as the wings members discussed above with reference to FIGS. 1 to 8.

The first and second lower wing members 118, 120 are positioned at a position beneath the equatorial circumference of the spherical central section 114. Above the equatorial circumference of the spherical housing 112 are the first and second upper wing members 122, 124. Between the first and second upper wing members 122, 124 and the first and second lower wing members 118, 120 the first and second central wing members 126, 128 are positioned along the equatorial plane of the spherical housing 112.

As with the embodiment disclosed above with reference to FIGS. 1 to 8 a central driver mounting plate 177 is secured to the spherical central section 114 at a position beneath the first and second lower wing members 118, 120 in a central location along the spherical central section 114. A low-frequency driver 178 is mounted to the driver mounting plate 177 in alignment with an aperture 180 formed in the driver mounting plate 176. The low-frequency driver 178 is positioned to fire away from the central cavity 116 of the spherical central section 114 with the convex portion 181 of the cone 194 of the low-frequency driver 178 facing the cavity 116 of the spherical central section 114.

Positioned beneath the low-frequency driver 178, and functioning as both a support and filter for the loudspeaker module 110, is the base assembly 113. The base assembly 113 is constructed as described above with reference to FIGS. 1 to 8. As such, the specific shapes of the elements of the base assembly 13 and the low-frequency driver 78 may be varied to optimize sound characteristics generated in accordance with the present subwoofer module 10.

A full range of sounds is achieved by integrating a mid-range/high-frequency driver 214 within the loudspeaker module 110. This is achieved by constructing the housing 112 with the mid-range/high-frequency driver support 212 discussed above. The mid-range/high-frequency driver support 212 is selectively movable between a closed orientation where the upper surface 216 thereof conforms with the outer surface 218 of the primary housing portion 210 and an open orientation where the mid-range/high-frequency driver support 212 is pivotally moved from the primary housing portion 210 to reveal the mid-range/high-frequency driver 214 for the transmission of sound therefrom.

More particularly, the mid-range/high-frequency driver support 212 is formed at the top of the housing 112 at a position above the first and second upper wing members 122, 124 such that the first and second wing member 122, 124 are between the mid-range/high-frequency driver support 212 and the first and second central wing members 126, 128. The mid-range/high-frequency driver support 212 takes the form of a spherical cap as the mid-range/high-frequency driver support 212 is that portion of the sphere defined by the housing 112 which lies above a given plane parallel to and situated above the first and second upper wing members 122, 124.

The mid-range/high-frequency driver support 212 includes an upper surface 216 conforming to the shape of the spherical central section 114 and thereby defining the exterior surface of the mid-range/high-frequency driver support 212 when in its closed orientation. The mid-range/high-frequency driver support 212 also includes a lower surface 220 opposite the upper surface 216. Because the upper surface 216 is curved the upper surface 216 and lower surface 220 meet to define a substantially circumferential edge 222 of the mid-range/high-frequency driver support 212. A hinged portion 224 of the edge 222 of the mid-range/high-frequency driver support 212 is secured to the primary housing portion 210 via a hinge 226 such that the remainder of the substantially circumferential edge 222 of the mid-range/high-frequency driver support 212 that is not secured to the primary housing portion 212 via the hinge 226 may be selectively rotated from the primary housing portion 212 of the housing 112 so as to expose the lower surface 220 of the mid-range/high-frequency driver support 212. Secured to the lower surface 220 of the mid-range/high-frequency driver support 212 is a mid-range/high-frequency driver 230.

Because rotation of the mid-range/high-frequency driver support 212 would ultimately open the cavity 116 defined by the housing 112, that primary housing portion 210 along the given parallel plane situated above the first and second upper wing members 122, 124 includes a wall 232 to enclose the cavity 116. The wall 232 is formed with a concave recess 234 so as to allow for positioning of the mid-range/high-frequency driver 230 therein when the mid-range/high-frequency driver support 212 is in its closed orientation.

As with the prior embodiment, the housing 112 is further provided with a wire passage aperture 182 for the passage there through of wires (not shown) powering the low-frequency driver 178 and the mid-range/high-frequency driver 230. The resulting loudspeaker module 110 is wired in a conventional manner, which those skilled in the art will readily appreciate.

As with the embodiment disclosed above with reference to FIGS. 1 to 8, the sealed enclosure defined by the hollow spherical central section 114, the first and second upper wing members 122, 124, the first and second lower wing members 118, 120 and the first and second central wing members 126, 128 results in a large surface area enhancing the resonating characteristics of the housing 112. Still further, the expanded cavity defined by the spherical central section 114 and the wing members 118, 120, 122, 124, 126, 128 increase the space behind the low-frequency driver 178 to optimize the range of frequencies that may be reproduced. As a result improved sound is achieved while retaining the relatively compact size of the loudspeaker module 110.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A subwoofer module, comprising:

a housing composed of a hollow spherical central section having a central cavity and a plurality of wing members extending from the spherical central section, wherein each of the plurality of wing members includes a wing member cavity in fluid communication with the central cavity of the spherical central section;

a central driver mounting plate secures a low-frequency driver to an aperture formed in the spherical central section.

2. The subwoofer module according claim 1, wherein the housing is substantially spherical.

3. The subwoofer module according claim 1, wherein the plurality of wing members includes pairs of wing members oriented parallel to each other.

4. The subwoofer module according claim 3, wherein each of the plurality of wing members includes an upper surface, a bottom surface and a side wall extending between the upper surface and the bottom surface, the upper surface, the bottom surface and the side wall define a wing member cavity which is in fluid communication with the central cavity of the spherical central section.

5. The subwoofer module according claim 3, wherein the plurality of wing members includes three pairs of wing members oriented parallel to each other.

6. The subwoofer module according claim 5, wherein each of the plurality of wing members includes an upper surface, a bottom surface and a side wall extending between the upper surface and the bottom surface, the upper surface, the bottom surface and the side wall define a wing member cavity which is in fluid communication with the central cavity of the spherical central section.

7. The subwoofer module according claim 1, wherein each of the plurality of wing members includes an upper surface, a bottom surface and a side wall extending between the upper surface and the bottom surface, the upper surface, the bottom surface and the side wall define a wing member cavity which is in fluid communication with the central cavity of the spherical central section.

8. The subwoofer module according claim 1, wherein the low-frequency driver is positioned to fire away from the central cavity of the spherical central section with a convex portion of a cone of the low-frequency driver facing the central cavity of the spherical central section.

9. The subwoofer module according claim 1, further including an excursion spacer secured to and in alignment with the low-frequency driver.

10. The subwoofer module according claim 1, further including an upper baffle plate and a lower baffle plate secured to and in alignment with the low-frequency driver.

11. The subwoofer module according claim 10, wherein the upper baffle plate is a disk-like member having a foam core that functions as a filter for unwanted frequencies transmitted by the low-frequency driver.

12. The subwoofer module according claim 10, wherein the lower baffle plate is frusto-conically shaped and includes inner and outer walls between which is positioned a foam gasket, wherein the inner and outer walls include a series of apertures shaped and dimensioned to optimize sound transmitted by the subwoofer module.

* * * * *